United States Patent [19]

Vetter

[11] 4,165,815

[45] Aug. 28, 1979

[54] COSMETIC CONTAINER WITH CLEANING SURFACE

[76] Inventor: Kathryn A. Vetter, 621 Dauphine St., Apt. 14, New Orleans, La. 70112

[21] Appl. No.: 871,323

[22] Filed: Jan. 23, 1978

[51] Int. Cl.[2] ..... B65D 7/04; B65D 1/24

[52] U.S. Cl. ..... 220/4 D; 220/23; 15/244 R

[58] Field of Search ..... 15/104.92, 244 R; 132/82, 83 R; 206/38, 229, 503, 581, 823; 220/4 C, 4 D, 23, 23.6, 23.83, 288

[56] References Cited

U.S. PATENT DOCUMENTS

| | | | |
|---|---|---|---|
| 2,077,219 | 4/1937 | Conner | 220/4 D |
| 2,271,589 | 2/1942 | Hendrickson | 220/23 |
| 2,326,414 | 8/1943 | Thompson | 220/4 D |
| 2,401,127 | 5/1946 | Younghusband | 15/244 R UX |
| 2,438,037 | 3/1948 | Chapman, Jr. | 15/104.92 X |
| 2,491,101 | 12/1949 | Freiberg | 220/23 X |
| 2,841,811 | 7/1958 | Carroll | 15/244 R |
| 2,961,682 | 11/1960 | Wurmböck et al. | 15/244 B X |
| 3,067,896 | 12/1962 | Berg et al. | 220/4 D X |

*Primary Examiner*—Davis T. Moorhead
*Attorney, Agent, or Firm*—Keaty and Garvey

[57] ABSTRACT

A multi-compartment cosmetic container is comprised of an upper and lower case, there being provided an inner container to one case into which a desired cosmetic product can be placed. The container can be used to hold a variety of cosmetic products, preferably those which are applied by means of the finger tips. The other case portion provides a sponge like surface for retaining a suitable cosmetic remover. The individual can drag her finger across the surface and remove any excess make-up or like cosmetic which may have accumulated during application. The first and second case can be attachable together in a suitable fashion which separates the two products, but nevertheless retains them in an individual overall container.

4 Claims, 8 Drawing Figures

COSMETIC CONTAINER WITH CLEANING SURFACE

BACKGROUND OF THE INVENTION

1. Field of the Invention

The present invention relates to a cosmetic container, more particularly to a multi-compartment cosmetic container which provides a desired cosmetic in one compartment and a suitable remover in the other. The two compartments are compatibly connected together to form a single overall container.

2. General Background and Prior Art

Several cosmetic products are applied by means of the finger tip rather than by a suitable brush or like applicator. These products include, for example, eye make-up, cheek blush, and lip gloss. These products are applied by the finger tip of the individual, which presents a problem of an excess of materials often left on the finger tip of the individual after the make-up is applied.

While an individual can then use a suitable make-up remover to clean the finger tip, this is an inconvenient method which is not often available to a woman who is in a hurry, or in a location which does not lend itself to this extra trouble.

3. General Discussion of the Present Invention

The present invention solves all the prior art problems and shortcomings in a simple and inexpensive manner. The present invention provides a pair of cases each of which has a container into which a desired cosmetic and a suitable remover can be placed respectively.

In the preferred embodiment, the lower most case provides an inner container into which a desired cosmetic product can be housed and has a threadable connection so that the second case can be threadably and sealably engaged thereonto. The second case which threadably engages and seals the first has a recess on its upper face into which a pourous substance such as a sponge can be placed and saturated with a desired remover. If desireable, the sponge can be tinted in a color to match the cosmetic product itself. A cap or lid seals the recess and the pourous member and its contained remover so that leakage is not a problem. The overall unit is a compact convenient and handy item which can be carried in the palm of the hand for example.

In the preferred embodiment, the overall lid is a hinged cap which snaps into place atop the upper case which houses the remover. In the preferred embodiment, the upper and lower case are interchangeable, each being provided with male threads on its upper portion and female threads on its underside so that each engages and seals with the other. The uppermost case can be sealed then by a suitable lid which is provided with the identical sized female threads.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
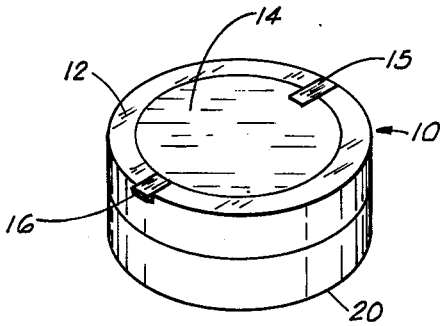
FIG. 1 is a perspective view of the preferred embodiment of the apparatus of the present invention.
Figure 2:
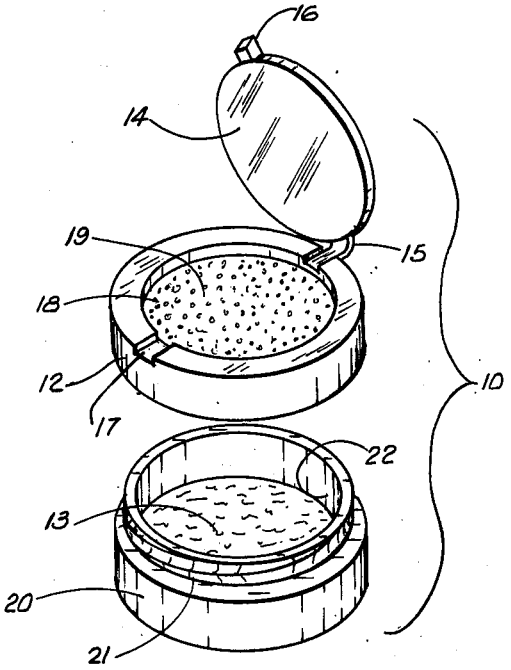
FIG. 2 is an exploded perspective view of the cosmetic container of FIG. 1.
Figure 3:
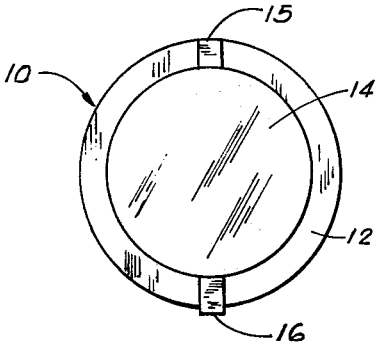
FIG. 3 is a top view of the cosmetic container of FIG. 1.
Figure 4:
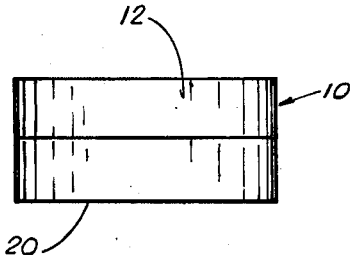
FIG. 4 is a side view of the cosmetic container of FIG. 1.
Figure 5:
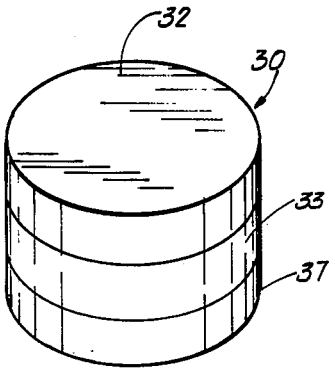
FIG. 5 is a perspective view of a second embodiment of the apparatus of the present invention.

FIGS. 1–4 best shows the preferred embodiment of the apparatus of the present invention. In FIG. 2, it can be seen a cosmetic container 10 which is comprised of upper case 12 and a lower case 20. Lower case 20 provides an inner container 22 into which a desired cosmetic product can be placed. A suitable cosmetic product which can be housed within lower case 20 would be lip gloss, eye make-up or cheek blush. These are of course only exemplary of a myriad of products which could be placed within case 10 within the teaching of the present invention.

Upper case 12 provides an inner recess 19 into which a sponge or like pourous liquid retaining member can be inserted. Sponge 18 would be sized to comfortably and completely fill recess 19. It would provide a porous substance into which a suitable remover could be placed. The remover would be a chemical which would be a suitable solvent to remove any cosmetic product 13 which may accumulate on the finger of the individual.

A lid 14 can be provided for sealing upper recess 19 and preventing leaking of the remover contained within sponge 18. In FIG. 2, lid 14 can be hingedly attached to upper case 12 by means of hinge 15. A suitable locking tab 16 would cooperation with a locking recess 17 as is best seen in FIG. 2 to insure a suitable closure of lid 14 onto upper case 12. Lower case 20 would be provided preferably with threads 21 which would engage with like female threads on the lower portion of upper case 12. Thus, upper and lower case 12 could be threadably engaged in a sealable fashion to prevent the escape of cosmetic product 13 from case 20.

FIGS. 5–8 best illustrate the alternative embodiment of the cosmetic container of the present invention. In FIGS. 5–8, the alternative embodiment of the cosmetic container of the present invention is designated generally by the numeral 30.

Figure 6:
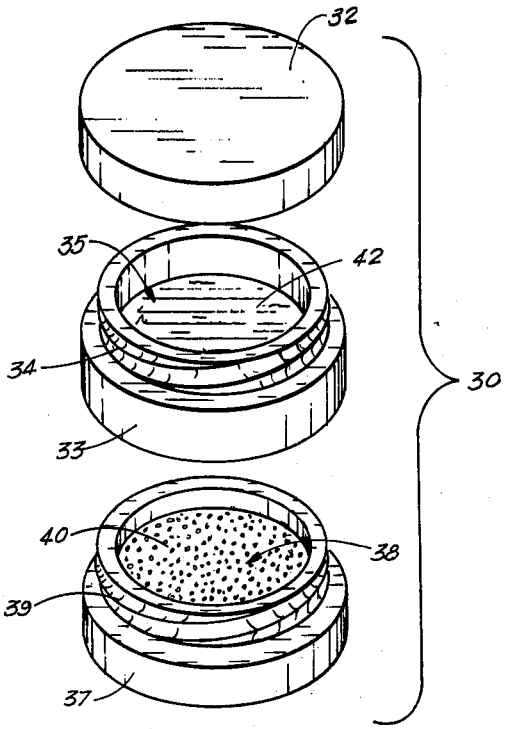
FIG. 6 is an exploded view of the alternative embodiment of the cosmetic container shown in FIG. 5.
Figure 7:
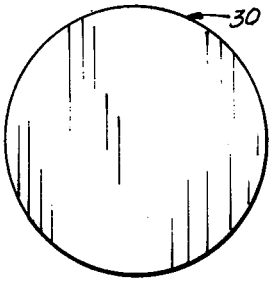
FIG. 7 is a top view of the cosmetic container shown in FIG. 5.
Figure 8:
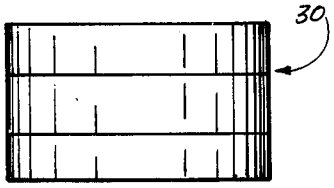
FIG. 8 is a side view of the cosmetic container shown in FIG. 5.

As can best be seen in FIG. 6, container 30 is comprised generally of an upper case 33 and a lower case 37. Upper case 33 provides an inner container 35 into which a desired cosmetic product 42 can be placed.

Upper case 33 could be provided with threads 34 which would engage with like female threads on lid 32. Thus, lid 32 could be engaged to form a sealable connection with container 33.

A lower most case 37 likewise provides male threads 39 which would engage with female threads on the lower side of case 33. A recess 38 is provided in lower case 37 into which a suitable sponge or like porous liquid retaining member 40 could be placed. Such a porous retaining member 40 could be saturated with a suitable remover for removing the cosmetic product 42 housed in upper container 33 when an excess of such product 42 is accumulated on the finger of the individual after applying the cosmetic as desired. Upper and lower cases 33, 37 can be manufactured to interchange, with each being provided with upper male threads 34 and lower female threads for threadably engaging the threads of the companion case 33, 37. Both cases 33, 37 so constructed would threadably engage with lid 32. The device so constructed would be easily re-assembled with minimal regard as to the particular location of either case 33, 37. Lid 32 could be quickly attached to either upper case 33 or lower case 37, with the remaining case being quickly attatched to the bottom therof as was more fully described above.

In the embodiment shown in FIGS. 1–4 and in the alternative embodiment shown in FIGS. 5–8, note that the containers are rounded and have an overall outer diameter which is substantially identical in each embodiment with the separate case members. Thus an overall asthetically pleasing cylinderical container is provided when each device is completely assembled. Note in FIG. 1 of the preferred embodiment that the upper case 12 and lower case 20 are substantially identical diameters. The overcall container 10 provides an asthetically pleasing cylinderical shape. In a like manner, the alternative embodiment shown in FIGS. 5–8 provides an overall asthetically pleasing cylindrical shape. Note that lid 32, upper case 33 and lower container 37 are shown to have substantially identical diameters, such that their assembly produces an overall asthetically pleasing cylindrical shape as can best be seen in FIGS. 5–8.

While the asthetically pleasing cylindrical shapes shown in FIGS. 1–8 are preferred embodiments, it should be understood that other shapes could be used to fit the fancy of the individual users and still be within the teaching of the present invention.

In both the embodiment shown in FIGS. 1 through 4 and the embodiment shown in FIGS. 5 through 8, there is provided a cosmetic containing portion designated in FIG. 2 as lower case 20 and in FIG. 6 as upper case 33. Each of these cases 20, 33 will be provided of a sufficient diameter so as to accommodate the fingertip of an individual thereinto, as the desired product will be a cosmetic product which is normally applied by means of the fingertip. Such a product will be for example lip gloss. In a like manner, each of the embodiments shown and described herein will provide a container or case for the housing of a suitable liquid retaining member such as a porous sponge and cosmetic solvent. The solvent which will be impregnated into the sponge 18, 40 will be a solvent which is suitable for removing the cooperative cosmetic product 13,42 which is housed in the appropriate portion of the overall container 10,30. Thus, it will be evident to one skilled in the art that the container 10,30 of the present invention will be manufactured in the generally small size with an inner diameter of such a dimension as to allow the fingertip of an individual to reach into the cosmetic product containing a portion of the container 10,30 and adhere some of the cosmetic product 13,42 to the fingertip for its application.

Because many varying and different embodiments may be made within the scope of the inventive concept herein taught, and because many modifications may be made in the embodiments herein detailed in accordance with the descriptive requirements of the law, it is to be understood that the details herein are to be interpreted sas illustrative and not in a limiting sense.

What is claimed as invention is:

1. A cosmetic container with cleaning surface comprising:

a. A lower case, said lower case having an inner container for the housing of a cosmetic product therein;

b. An upper case attachable to said lower case, said upper case providing an inner recess;

c. Solvent means in said upper case for dissolving said cosmetic product, said solvent means comprising a porous liquid retaining sponge saturated with a cosmetic solvent;

d. A lid attachable to said upper case, said lid forming a closure of said inner recess of said upper case, said upper case and said lower case being connectable with said upper container forming a closure of said inner container of said lower case when attached thereto said upper and said lower cases being further interchangeably connectable, said lower container being capable of forming a closure of said inner recess of said upper case when attached thereto, and said lid is attachable to said lower case, forming a closure of said inner portion thereof.

2. The apparatus of claim 1 wherein said upper case said lower case and said lid are all cylindrical having substantially identical diameters and said upper and said lower cases are threadably and interchangeably attachable to one another.

3. The container of claim 2 wherein said container in an assembled position is of a substantially cylindrical shape.

4. The container of claim 3 wherein said upper case and said lower case are both provided with male threads and female threads and are interchangeably attachable in a threadable fashion to one another, and said lid is provided with female threads and is threadably attachable to either said upper case or said lower case, and said upper and lower cases are substantially equally sized.

* * * * *